US005209311A

United States Patent [19]

Donsé

[11] Patent Number: 5,209,311

[45] Date of Patent: May 11, 1993

[54] DRILL STRING COMPONENT

[75] Inventor: Lennart Donsé, Värmdö, Sweden

[73] Assignee: Atlas Copco Construction and Mining Technique AB, Stockholm, Sweden

[21] Appl. No.: 787,069

[22] Filed: Nov. 4, 1991

[30] Foreign Application Priority Data

Nov. 14, 1990 [SE] Sweden ..... 9003627

[51] Int. Cl.[5] ..... E21B 17/16

[52] U.S. Cl. ..... 175/320; 138/44

[58] Field of Search ..... 175/320, 417; 138/44, 138/DIG. 11

[56] References Cited

U.S. PATENT DOCUMENTS 4,987,961 1/1991 McNeely, Jr. ..... 175/320

5,081,847 1/1992 Anderson, Jr. ..... 138/44 X 5,102,095 4/1992 Schmitt-Matzen et al. ..... 138/44 X

*Primary Examiner*—William P. Neuder

*Attorney, Agent, or Firm*—Eric Y. Munson; Mark P. Stone

[57] ABSTRACT

Drill string component for top hammer drilling comprising a rod (13) surrounded by a tube packet (4,5). The rod is provided with a thickened section (14) for cooperation with a diameter reduction (15) in the tube packet which at upwards drilling is situated below the section (14). Through this flushing liquid is prevented from flowing out of the drill string when the drill string is extended.

2 Claims, 1 Drawing Sheet

DRILL STRING COMPONENT

BACKGROUND OF THE INVENTION

The present invention relates to a drill string component for connection with other similar drill string components to a drill string for top hammer drilling, particularly in rock, said drill string comprising a set of tubes and a set of rods arranged in the set of tubes.

When drilling with tools of the above mentioned kind the problem arises when drilling long holes upwards that the large amount of flushing liquid between the set of rods and the set of tubes flows out when the drill tool is extended.

SUMMARY OF THE INVENTION

The present invention, which is defined in the subsequent claims, aims at achieving a device which prevents the liquid volume between the set of rods and the set of tubes from flowing out when extending the drill string.

BRIEF DESCRIPTION OF THE DRAWINGS

An embodiment of the invention is described below with reference to the accompanying drawings in which FIG. 1 schematically shows a rock drilling device comprising the invention.

DESCRIPTION OF THE BEST MODE FOR CARRYING OUT THE INVENTION

Figure 2:
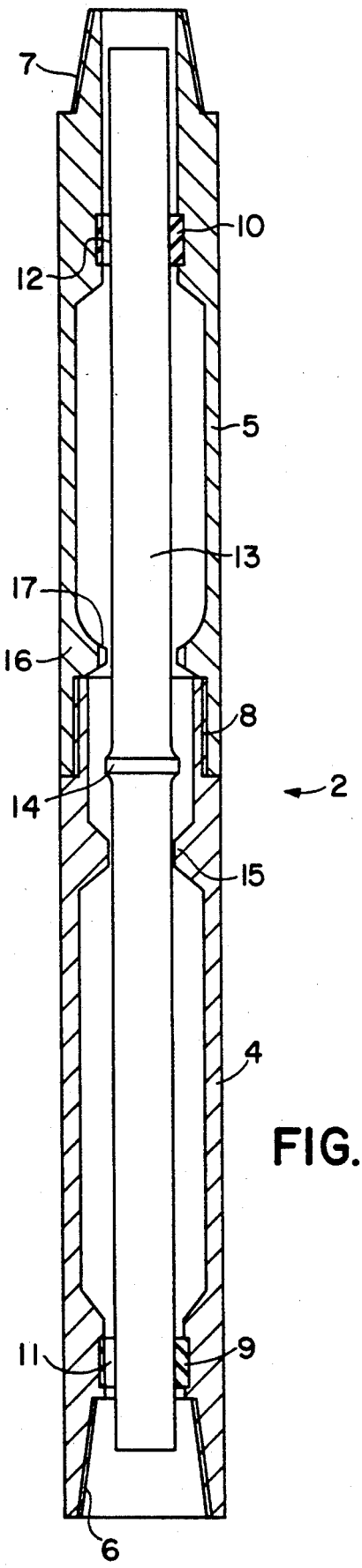
FIG. 2 shows a section through a drill string component according to the invention.
Figure 1:
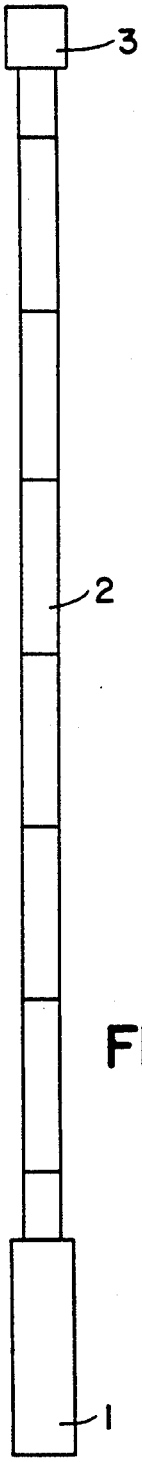

The rock drilling device shown in the drawings comprises a hammer drilling machine 1 which in a usual way is mounted on a not shown drill rig. A drill string comprising a number of interconnected drill string components 2 is connected to the rock drilling machine. The drill string transfers impact energy and rotation from the rock drilling machine to a drill bit 3 arranged at the front end of the drill string. Each drill string component comprises a rod 13 for transferring impact energy between the rock drilling machine and the drill bit and a tube packet comprising two tubes 4,5 interconnected by screw threads 8 around the rod 13. The tube packet is at its ends provided with conical threads 6,7 for connection of the drill string component with other similar drill string components or with the drill bit or a shank adapter aranged in the rock drilling machine. Threads 6,7 can have another form than the conical form. The essential thing is that they are easier to disconnect than the threads 8 so that the drill string component is kept as a unit when handled normally on the work site. Rod 13 is guided in the tube packet by bushings 9,10 provided with grooves 11,12 for passage of flushing liquid. Rod 13 is, suitably at its middle, provided with a section 14 with a larger diameter than other parts of the rod. A suitable way of achieving this thickened section is to friction weld two rods for the creation of rod 13. Tube 4 is provided with a diameter reduction 15 which when drilling upwards is situated below section 14 of rod 13. Tube 5 is provided with a diameter reduction 16 provided with a number of grooves 17 for passage of flushing liquid. The tube packet has between the diameter reductions 15,16 an internal diameter which is larger than the diameter of section 14 so that flushing liquid can pass section 14. When drilling upwards the rod in the drill string component below presses rod 13 to a position as shown in FIG. 2 so that flushing liquid can pass through the drill string to drill bit 3. When extending the drill string the rock drilling machine is retracted so that rod 13 sinks from the position shown in FIG. 2 to a position where section 14 comes to contact with diameter reduction 15 so that sealing is achieved between rod 13 and the tube packet. Through this it is prevented that flushing liquid above the seal flows out from the drill string.

I claim:

1. A first drill string component connectable to at least a second drill string component of a top hammer drilling apparatus including a rock drilling machine (1) and a drill bit (3), said drill string components being disposed between said rock drilling machine and said drill bit, said first drill string component comprising a rod (13) for transferring impact energy between said rock drilling machine and said drill bit arranged at a front end of said first drill string, and a tube packet (4, 5) positioned around said rod, said tube packet comprising two tubes for transferring rotational movement between said rock drilling machine and said drill bit, said rod having a section defining a diameter larger than other portions of said rod, said tube packet (4, 5) having a section defining a diameter less than other portions of said tube packet, said lesser diameter section of said tube packet being positioned below said larger diameter section of said rod during drilling in an upward orientation, said larger diameter section of said rod and said lesser diameter section of said tube packet being defined for sealing cooperation with each other.

2. The drill string component as claimed in claim 1 wherein said larger diameter section of said rod is defined substantially at the longitudinal center of said rod.

* * * * *